US006322484B1

(12) United States Patent
Muller

(10) Patent No.: US 6,322,484 B1
(45) Date of Patent: Nov. 27, 2001

(54) ABDOMINAL EXERCISE DEVICE

(76) Inventor: Lynthia A. Muller, 332 Nykobing, Solvang, CA (US) 93463

( * ) Notice: Subject to any disclaimer, the term of this patent is extended or adjusted under 35 U.S.C. 154(b) by 0 days.

(21) Appl. No.: 09/685,323

(22) Filed: Oct. 10, 2000

(51) Int. Cl.[7] ..... A63B 26/00
(52) U.S. Cl. ..... 482/140; 482/148
(58) Field of Search ..... 482/140, 148, 482/142; 5/690, 716, 665, 2.1; D6/596, 382

(56) References Cited

U.S. PATENT DOCUMENTS 5,332,202 * 7/1994 Wagner et al. ..... 267/82
5,368,537 * 11/1994 Felice ..... 482/140
5,421,800 * 6/1995 Mullen ..... 484/121
5,474,513 * 12/1995 Carlesimo et al. ..... 482/140

* cited by examiner

*Primary Examiner*—Jerome W. Donnelly
*Assistant Examiner*—Lori Baker Amerson
(74) *Attorney, Agent, or Firm*—Joseph N. Breaux

(57) ABSTRACT

An abdominal exercise device that includes a bendable, contoured, cushion surface upon which the user may properly perform sit-ups, stomach crunches, etc. The exercise device also includes strap assemblies and elastic resistance bands to allow the user to perform other exercises.

1 Claim, 3 Drawing Sheets

ABDOMINAL EXERCISE DEVICE

TECHNICAL FIELD

The present invention relates to exercise equipment and more particularly to an ergonomically designed abdominal exercise device for performing set-ups or crunches that includes a rigid base/frame assembly, a user support cushion assembly, two adjustable stretch bands, two leg/arm strap assemblies each including a detachable base/frame attachment fastener at one end and a user adjustable extremity fastening belt at the other end, and eight adjustable spring assemblies each interconnected between a top support plate of the rigid base/frame assembly and one of two hingedly connected, rigid, contoured back cushion support plates of the user support cushion assembly; the rigid base/frame assembly including a rigid base structure having a top surface and four tubular frame members each rigidly affixed to and extending upwardly from a separate corner of a rectangular base structure support frame upon which the rigid base structure is mounted; the rigid base frame assembly having two spaced pairs of leg/arm strap assembly connecting rings provided at each opposed end thereof to which the detachable base/frame attachment fastener of the leg/arm fastener straps are attachable; the user support cushion assembly including two hingedly connected, rigid, contoured back cushion support plates that are connected by a center hinge and which are each hingedly connected at an opposite end thereof to the top ends of two of the four tubular frame members and a user support cushion formed of open cell foam and bonded to and covering the top surfaces of the two hingedly connected, rigid, contoured back cushion support plates; each of the two adjustable stretch bands being adjustably connected between a respective pair of top ends of the four tubular frame members to which an opposite end of a back cushion support plate is hingedly connected; each of the eight adjustable spring assemblies including a support spring, a spring bottom end retaining cup having a cavity within which a bottom end of the support spring is secured and a bottom cup structure rigidly affixed to the top surface of the rigid base structure and a spring top end retaining cup assembly rigidly affixed to a bottom surface of one of the two hingedly connected, rigid, contoured back cushion support plates and having a spring holding mechanism including a spring top end receiving cavity and a spring securing pin insertable through the sidewalls of the spring top end retaining cup assembly and the spring top end such that the user can select the length of the spring top end held within spring top end receiving cavity and thereby adjust the effective spring distance between the top surface of the rigid base structure and the bottom surface of the respective rigid, contoured back cushion support plate.

BACKGROUND ART in order to maintain a firm abdomen, it is important to properly exercise the correct muscle groups by doing abdominal crunches, sit-ups and the like. Although doing these exercises on a flat mat or floor surface can be effective, performing these exercises on a flat surface can be uncomfortable and also ends to cause the exerciser to perform the exercise improperly in an effort to relieve the discomfort caused by performing the proper muscle movements on a flat surface. It would be desirable, therefore, to have an abdominal exercise device that included a bendable, contoured, cushion surface upon which the user could properly perform sit-ups, stomach crunches, etc. It would be further desirable to have such an exercise machine that further included strap assemblies and elastic resistance bands to allow the user to perform other exercises.

GENERAL SUMMARY DISCUSSION OF INVENTION

It is thus an object of the invention to provide an abdominal exercise device that includes a rigid base/frame assembly, a user support cushion assembly, two adjustable stretch bands, two leg/arm strap assemblies each including a detachable base/frame attachment fastener at one end and a user adjustable extremity fastening belt at the other end, and eight adjustable spring assemblies each interconnected between a top support plate of the rigid base/frame assembly arid one of two hingedly connected, rigid, contoured back cushion support plates of the user support cushion assembly; the rigid base/frame assembly including a rigid base structure having a top surface and four tubular frame members each rigidly affixed to and extending upwardly from a separate corner of a rectangular base structure support frame upon which the rigid base structure is mounted; tie rigid base frame assembly having two spaced pairs of leg/arm strap assembly connecting rings provided at each opposed end thereof to which the detachable base/frame attachment fastener of the leg/arm fastener straps are attachable; the user support cushion assembly including two hingedly connected, rigid, contoured back cushion support plates that are connected by a center hinge and which are each hingedly connected at an opposite end thereof to the top ends of two of the four tubular frame members and a user support cushion formed of open cell foam and bonded to and covering the top surfaces of the two hingedly connected, rigid, contoured back cushion support plates; each of the two adjustable stretch bands being adjustably connected between a respective pair of top ends of the four tubular frame members to which an opposite end of a back cushion support plate is hingedly connected; each of the eight adjustable spring assemblies including a support spring, a spring bottom end retaining cup having a cavity within which a bottom end of the support spring is secured and a bottom cup structure rigidly affixed to the top surface of the rigid base structure and a spring top end retaining cup assembly rigidly affixed to a bottom surface of one of the two hingedly connected, rigid, contoured back cushion support plates and having a spring holding mechanism including a spring top end receiving cavity and a spring securing pin insertable through the sidewalls of the spring top end retaining cup assembly and the sprints top end such that the user can select the length of the spring top end held within spring top end receiving cavity and thereby adjust the effective spring distance between the top surface of the rigid base structure and the bottom surface of the respective rigid, contoured back cushion support plate.

Accordingly, an abdominal exercise device is provided. The abdominal exercise device includes a rigid base/frame assembly, a user support cushion assembly, two adjustable stretch bands, two leg/arm strap assemblies each including a detachable base/frame attachment fastener at one end and a user adjustable extremity fastening belt at the other end, and eight adjustable spring assemblies each interconnected between a top support plate of the rigid base/frame assembly and one of two hingedly connected, rigid, contoured back cushion support plates of the user support cushion assembly; the rigid base/frame assembly including a rigid base structure having a top surface and four tubular frame members each rigidly affixed to and extending upwardly from a separate corner of a rectangular base structure support frame upon which the rigid base structure is mounted; the rigid base frame assembly having two spaced pairs of leg/arm strap assembly connecting rings provided at each opposed end thereof to which the detachable base/frame attachment fastener of the leg/arm fastener straps are attachable; the user support cushion assembly including two hingedly connected, rigid, contoured back cushion support plates that are connected by a center hinge and which are each hingedly connected at an opposite end there to the top ends of two of the four tubular frame members and a user support cushion formed of open cell foam and bonded to and covering the top surfaces of the two hingedly connected, rigid, contoured back cushion support plates; each of the two adjustable stretch bands being adjustably connected between a respective pair of top ends of the four tubular frame members to which an opposite end of a back cushion support plate is hingedly connected; each of the eight adjustable spring assemblies including a support spring, a spring bottom end retaining cup having a cavity within which a bottom end of the support spring is secured and a bottom cuo structure rigidly affixed to the top surface of the rigid base structure and a spring top end retaining cup assembly rigidly affixed to a bottom surface of one of the two hingedly connected, rigid, contoured back cushion support plates and having a spring holding mechanism including a spring top end receiving cavity and a spring securing pin insertable through the sidewalls of the spring top end retaining cup assembly and the spring top end such that the user can select the length of the spring top end held within spring top end receiving cavity and thereby adjust the effective spring distance between the top surface of the rigid base structure and the bottom surface of the respective rigid, contoured back cushion support plate.

BRIEF DESCRIPTION OF DRAWINGS for a further understanding of the nature and objects of the present invention, reference should be made to the following detailed description, taken in conjunction with the accompanying drawings, in which like elements are given the same or analogous reference numbers and wherein:

FIG. 1 is a perspective view of an exemplary embodiment of the abdominal exercise device of the present invention showing the rigid base/frame assembly, the user support cushion assembly, the two adjustable stretch bands, the two leg/arm strap assemblies each including a detachable base/frame attachment fastener at one end and a user adjustable extremity fastening belt at the other end, and the eight adjustable spring assemblies each interconnected between a top support plate of the rigid base/frame assembly and one of two hingedly connected, rigid, contoured back cushion support plates of the user support cushion assembly; the rigid base/frame assembly including a rigid base structure having a top surface and four tubular frame members each rigidly affixed to and extending upwardly from a separate corner of a rectangular base structure support frame upon which the rigid base structure is mounted; the rigid base frame assembly having two spaced pairs of leg/arm strap assembly connecting rings provided at each opposed end thereof to which the detachable base/frame attachment fastener of the leg/arm fastener straps are attachable; the user support cushion assembly including two hingedly connected, rigid, contoured back cushion support plates that are connected by a center hinge and which are each hingedly connected at an opposite end thereof to the top ends of two of the four tubular frame members and a user support cushion formed of open cell foam and bonded to and covering the top surfaces of the two hingedly connected, rigid, contoured back cushion support plates; each of the two adjustable stretch bands being adjustably connected between a respective pair of top ends of the four tubular frame members to which an opposite end of a back cushion support plate is hingedly connected; each of the eight adjustable spring assemblies including a support spring, a spring bottom end remaining cup having a cavity within which a bottom end of the support springs secured and a bottom cup structure rigidly affixed to the top surface of the rigid base structure and a spring top end retaining cup assembly rigidly affixed M a bottom surface of one of the two hingedly connected, rigid, contoured back cushion support plates and having a spring holding usechanis including a spring top end receiving cavity and a spring securing pin insertable through the sidewalls of the spring top end retaining cup assembly and the spring hop end such that the user can select the length of the spring top end held within spring top end receiving cavity and thereby adjust the effective spring distance between the top surface of the rigid base structure and the bottom surface of the respective rigid, contoured back cushion support plate.

EXEMPLARY MODE FOR CARRYING OUT THE INVENTION

Figure 1:
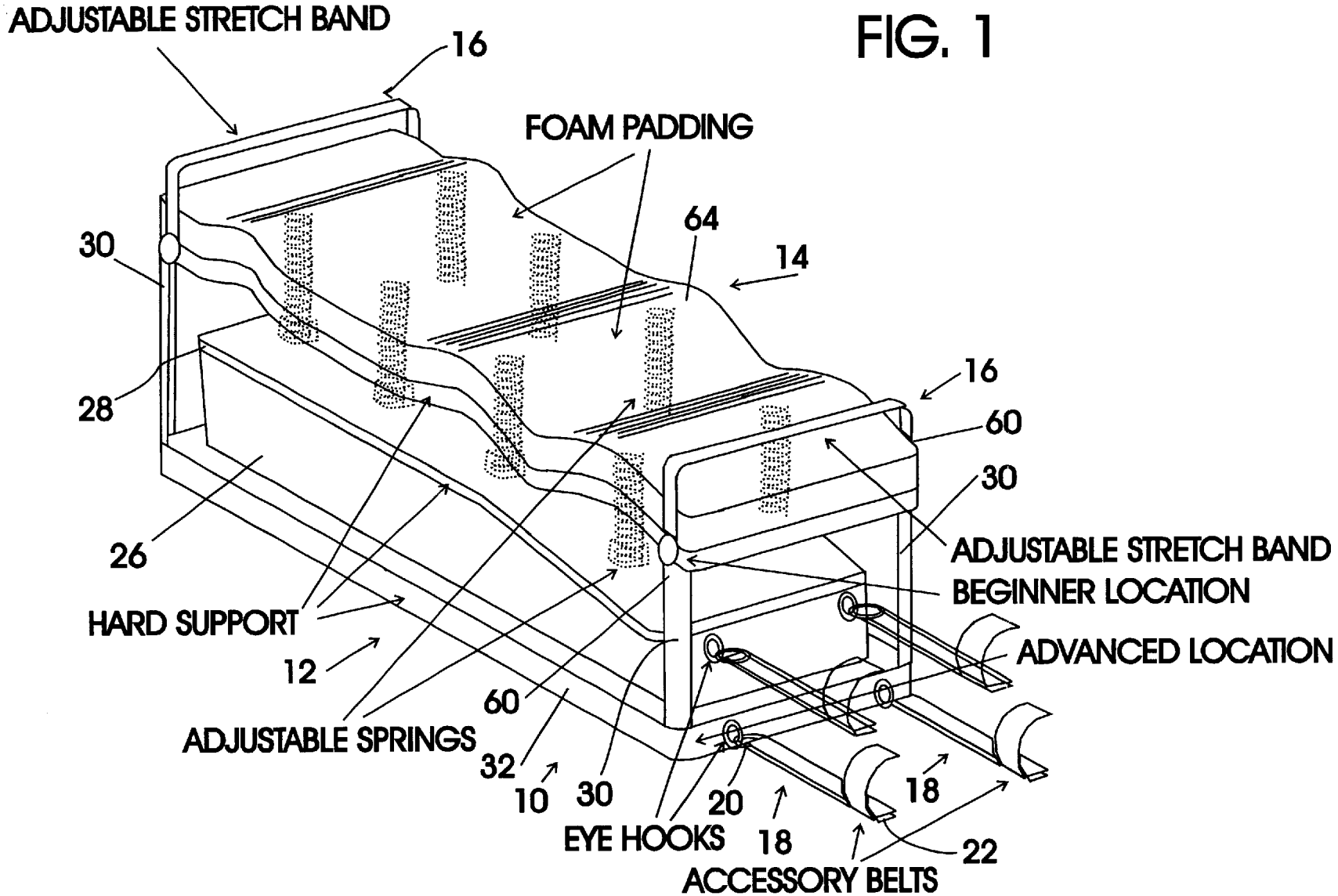
Figure 2:
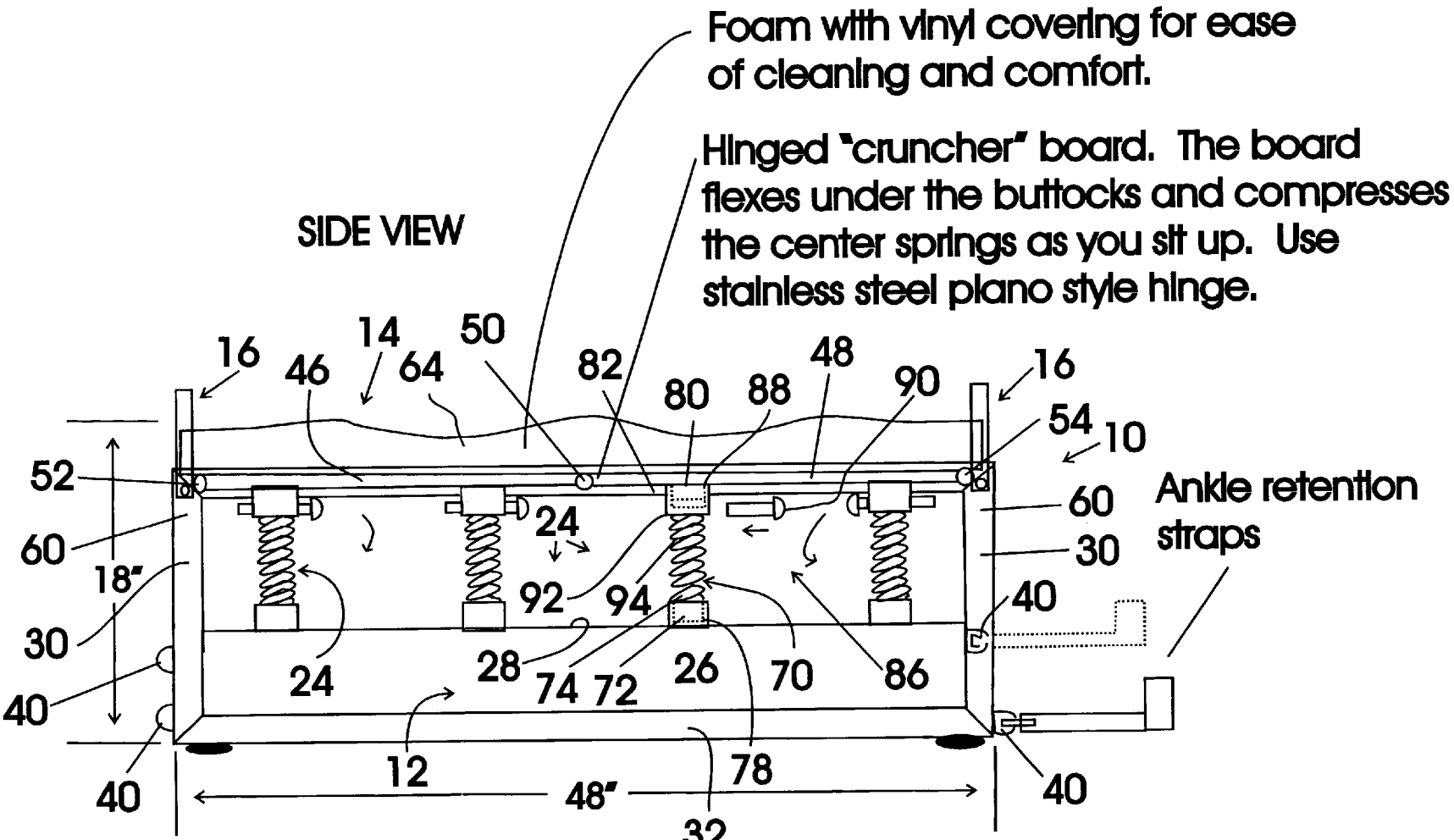
FIG. 2 is a side plan view of the abdominal exercise device of FIG. 1.
Figure 3:
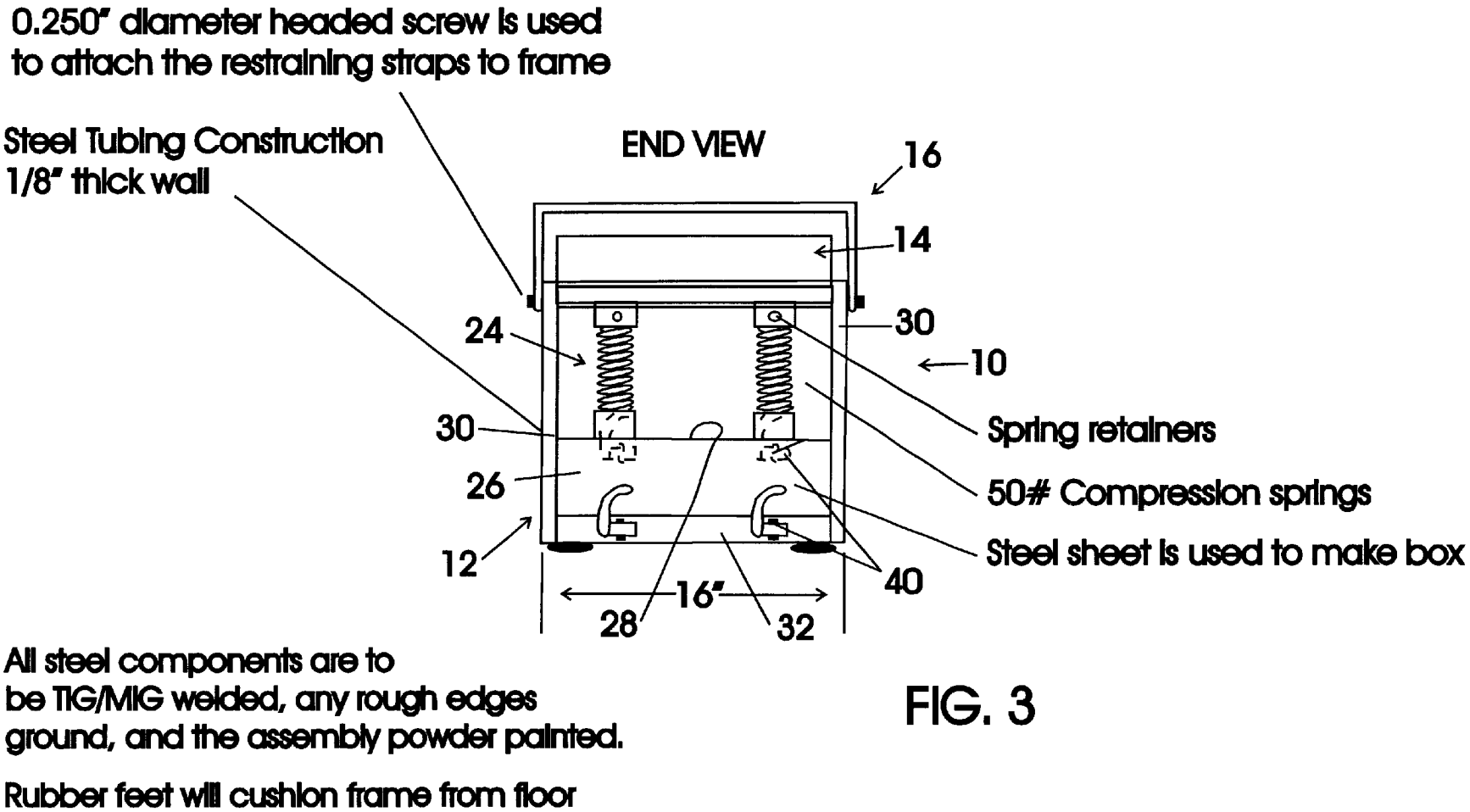
FIG. 3 is an end plan view of the abdominal ethercis device of FIG. 1.

FIGS. 1–3 show various exemplary embodiments of the abdominal exercise device of the present invention generally designated 10. Abdominal exercise device 10 includes a rigid base/frame assembly, generally designated 12; a user support cushion assembly, generally designated 14; two adjustable stretch bands, each generally designated 16; two leg/arm strap assemblies, each generally designated 18, and each including a detachable base/frame attachment fastener 20 at one end and a user adjustable extremity fastening belt 22 at the other end; and eight adjustable spring assemblies, each generally designated 24;

Rigid base/frame assembly 12 is constructed from steel and includes a rigid base structure 26 having a top surface 28 and four tubular frame members 30 each rigidly affixed to and extending upwardly from a separate corner of rectangular base structure support frame 32 upon which rigid base structure 26 is mounted. Rigid base frame assembly 12 also has two spaced pairs of leg/arm strap assembly connecting rings 40 provided at: each opposed end thereof to which detachable base/frame attachment fastener 20 of the leg/arm fastener straps 18 are attachable.

User support cushion assembly 14 including two hingedly connected, rigid, contoured back cushion support plates 46,48 that are connected by a center piano type hinge 50 and which are each hingedly connected at an opposite end 52,54, respectively, thereof to the top) encls 60 of two of the four tubular frame members 30 and a contoured, user support cushion 64 formed of open cell foam and bonded to and covering the top surfaces of the two hingedly connected, rigid, contoured back cushion support plates 46,48. Each of the two adjustable stretch bands 16 are adjustably connected between a respective pair of top ends 60 of the four tubular frame members 30 to which an opposite end 52,54 of a back cushion support plate 46,48 is hingedly connected.

Each of the eight adjustable spring assemblies 24 includes a stainless steel support spring, generally designated 70; a spring bottom end retaining cup 72 (shown in dashed lines) having a cavity within which a bottom end 14 of support spring 70 is secured and a bottom cup structure 78 rigidly affixed to top surface 28 of rigid base structure 26 and a spring top end retaining cup assembly 80 rigidly affixed to a bottom surface 82 of one of the two hingedly connected, rigid, contoured back cushion support plates 46,48 and having a spring holding mechanism, generally designated 86, including a spring top end receiving cavity 88 (shown in dashed lines) and a spring securing pin 90 insertable through the aligned pin openings 92 formed through sidewalls of spring top end retaining cup assembly 80 and the spring top end 94 such that the user can select the length of the spring top end held 94 within spring top end receiving cavity 88 and thereby adjust the effective spring distance between the top surface 28 of rigid base structure 26 and the bottom surface 80 of the respective rigid, contoured back cushion support plate 46,48.

It can be seen from the preceding description that an abdominal exercise device has been provided.

It is noted that the embodiment of the abdominal exercise device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An abdominal exercise device comprising:

a rigid base/frame assembly;

a user support cushion assembly;

two adjustable stretch bands;

two leg/arm strap assemblies each including a detachable base/frame attachment fastener at one end and a user adjustable extremity fastening belt at an opposite end; and eight adjustable spring assemblies each interconnected between a top support plate of said rigid base/frame assembly and one of two hingedly connected, rigid, contoured back cushion support plates of sail user support cushion assembly;

said rigid base/frame assembly including a rigid base structure having a top surface and four tubular frame members each ligitly affixed to and extending upwardly from a separate corner of a rectangular base structure support frame upon which said rigid base structure is mounted;

said rigid base frame assembly having two spaced pairs of leg/arm strap assembly connecting rings provided at each opposed end thereof to which said detachable base/frame attachment fastener of said leg/arm fastener straps are attachable;

said user support cushion assembly including two hingedly connected, rigid, contoured back cushion support plates that are connected by a center hinge and which are each hingedly connected at an opposite end thereof to said top ends of two of said four tubular frame members and a user support cushion formed of open cell foam and bonded, rigid, contoured back cushion support plates;

each of said two adjustable stretch bands being adjustably connected between a respective pair of top ends of said four tubular frame members to which an opposite end of a back cushion supported plate is hingedly connected;

each of said eight adjustable spring assemblies including a support spring, a spring bottom end retaining cup having a cavity within which a bottom end of said support spring is secured and a bottom cup structure rigidly affixed to said top surface of said rigid base structure and a spring top end retaining cup assembly rigidly affixed to a bottom surface of one of said two hingedly connected, rigid, contoured back cushion support plates and having a spring holding mechanism including a spring top end receiving cavity and a spring securing pin insertable through said sidewalls of said spring top end retaining cup assembly and said spring top end such that said user can select said length of said spring top end held within spring top crd receiving cavity and thereby adjust said effective spring distance between said top surface of said rigid base structure and said bottom surface of said respective rigid, contoured back cushion support plate.

* * * * *